US010460648B2

(12) United States Patent
Liao et al.

(10) Patent No.: US 10,460,648 B2
(45) Date of Patent: Oct. 29, 2019

(54) DISPLAY PANEL DRIVEN IN A COLUMN INVERSION AND DOT INVERSION AND METHOD FOR CONTROLLING THE SAME

(71) Applicant: AU OPTRONICS CORPORATION, Hsin-chu (TW)

(72) Inventors: Pei-Chun Liao, Hsin-chu (TW); Cheng-Ta Yang, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/794,907

(22) Filed: Oct. 26, 2017

(65) Prior Publication Data

US 2018/0218664 A1 Aug. 2, 2018

(30) Foreign Application Priority Data

Feb. 2, 2017 (TW) ..... 106103481 A

(51) Int. Cl.
*G09G 3/20* (2006.01)

(52) U.S. Cl.
CPC ..... *G09G 3/2092* (2013.01); *G09G 3/20* (2013.01); *G09G 2310/0254* (2013.01); *G09G 2310/063* (2013.01); *G09G 2310/08* (2013.01); *G09G 2320/0247* (2013.01); *G09G 2340/0435* (2013.01)

(58) Field of Classification Search
CPC ..... G09G 3/2092
USPC ..... 345/209
See application file for complete search history.

(56) References Cited

U.S. PATENT DOCUMENTS

| | | | | |
|---|---|---|---|---|
| 7,079,097 | B2 | 7/2006 | Lee | |
| 8,497,830 | B2 | 7/2013 | Liu et al. | |
| 8,830,279 | B2 | 9/2014 | Cheng et al. | |
| 2005/0078069 | A1* | 4/2005 | Aiba | G09G 3/3648 345/87 |
| 2008/0024408 | A1 | 1/2008 | Sano et al. | |

(Continued)

FOREIGN PATENT DOCUMENTS

| | | | |
|---|---|---|---|
| TW | 200807374 | A | 2/2008 |
| TW | 200931971 | A | 7/2009 |

(Continued)

OTHER PUBLICATIONS

Office Action issued by (TIPO) Intellectual Property Office, Ministry of Economic Affairs, R. O. C. dated Jun. 13, 2017 for Application No. 106103481, Taiwan.

*Primary Examiner* — Long D Pham
(74) *Attorney, Agent, or Firm* — Tim Tingkang Xia, Esq.; Locke Lord LLP

(57) ABSTRACT

A method for controlling a display panel includes steps of: providing a display panel, where the display panel includes a plurality of pixels arranged into a plurality of columns and rows and a plurality of data lines, where one of the data lines is coupled to pixels arranged in odd number rows of one of two columns which are adjacent to the one of the data lines, and coupled to pixels arranged in even number rows of the other one of two columns which are adjacent to the one of the data lines; receiving the data signals in a driving manner of column inversion by the data lines during a display period; and receiving the data signals in a driving manner of N-dot inversion by the data lines during a blanking period.

14 Claims, 7 Drawing Sheets

700

(56) References Cited

U.S. PATENT DOCUMENTS

| | | | | |
|---|---|---|---|---|
| 2014/0111495 | A1* | 4/2014 | Iwase | G09G 3/3677 345/211 |
| 2014/0292627 | A1* | 10/2014 | Pyun | G09G 3/3614 345/96 |
| 2016/0171944 | A1* | 6/2016 | Namkung | G09G 3/3648 345/96 |
| 2016/0314755 | A1* | 10/2016 | Feng | G09G 3/3655 |

FOREIGN PATENT DOCUMENTS

| | | | |
|---|---|---|---|
| TW | 201135695 | A | 10/2011 |
| TW | 201239838 | A | 10/2012 |

* cited by examiner

| | Upper part of a panel | Middle part of a panel | Lower part of a panel |
|---|---|---|---|
| R255 | -52.2 | -52.8 | -53.7 |
| G255 | -52.1 | -52.7 | -53.4 |
| B255 | -52.1 | -52.8 | -53.5 |
| W255 | -52.3 | -52.9 | -53.7 |
| W128 | -52.4 | -52.7 | -53.6 |
| W0 | -52.4 | -52.8 | -53.5 |

FIG. 6A

| | Upper part of a panel | Middle part of a panel | Lower part of a panel |
|---|---|---|---|
| R255 | -48.6 | -47.2 | -44.1 |
| G255 | -42.9 | -39.3 | -37.6 |
| B255 | -40.8 | -45.8 | -59.5 |
| W255 | -49.9 | -46.6 | -44.0 |
| W128 | -49.2 | -46.7 | -43.9 |
| W0 | -48.8 | -47.0 | -43.9 |

FIG. 6B

DISPLAY PANEL DRIVEN IN A COLUMN INVERSION AND DOT INVERSION AND METHOD FOR CONTROLLING THE SAME

CROSS-REFERENCE TO RELATED PATENT APPLICATION

This application claims priority to and the benefit of, pursuant to 35 U.S.C. § 119(a), patent application Serial No. 106103481 filed in Taiwan on Feb. 2, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

This application relates to a display technology, and in particular, to a display panel and a method for controlling the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the field of displays used by electronic sports, to resolve a problem that complicated image operation of an image in an electronic sports game does not match a display frame rate of a display, and avoid conditions of damaged images and inconsistency between images, common knowledge that a high frame rate is collocated with a dynamically adjusted blanking period to generate a low frequency holding rate is a technology, referred to as a dynamic matching technology (such as the G-SYNC technology proposed by NVIDA), for resolving the above mismatching phenomenon.

However, if a display needs to implement a high frame rate and a low holding rate at a same time, a flicker phenomenon generated at a low frequency (such as 30 Hz (Hz)) affects display quality of the display. Therefore, how to improve a flicker phenomenon to improve display quality of a display becomes a goal of the art.

SUMMARY

Summary of the invention is directed to provide a simplified abstract of content of the present disclosure, so that a reader has a basic understanding of the content of the present disclosure. The summary of the invention is not a complete summary of the content of the present disclosure, and is not directed to point out important/crucial components of embodiments this application or define the scope of this application.

One objective of the content of this application is to provide a display panel and a method for controlling the same, to improve the problem of the related art.

A technical aspect of the content of this application relates to a method for controlling a display panel. The method for controlling a display panel includes steps of: providing a display panel, where the display panel includes a plurality of pixels arranged into a plurality of columns and rows and a plurality of data lines, where one of the data lines is coupled to pixels arranged in odd number rows of one of two columns which are adjacent to the one of the data lines, and coupled to pixels arranged in even number rows of the other one of two columns which are adjacent to the one of the data lines; receiving the data signals in a driving manner of column inversion by the data lines during a display period; and receiving the data signals in a driving manner of N-dot inversion by the data lines during a blanking period.

Another technical aspect of the content of this application relates to a display panel, including a plurality of pixels and a plurality of data lines. The pixels are arranged in a plurality of columns and rows. One of the data lines is coupled to pixels arranged in odd number rows of one of two columns which are adjacent to the one of the data lines, and coupled to pixels arranged in even number rows of the other one of two columns which are adjacent to the one of the data lines. The data lines receive data signals in a manner of column inversion during a display period; and receive data signals in a manner of N-dot inversion during a blanking period.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein:

FIG. 6A is a diagram of experimental data according to an embodiment of this application;

FIG. 6B is a diagram of experimental data according to a comparative example.

DETAILED DESCRIPTION

Figure 1:
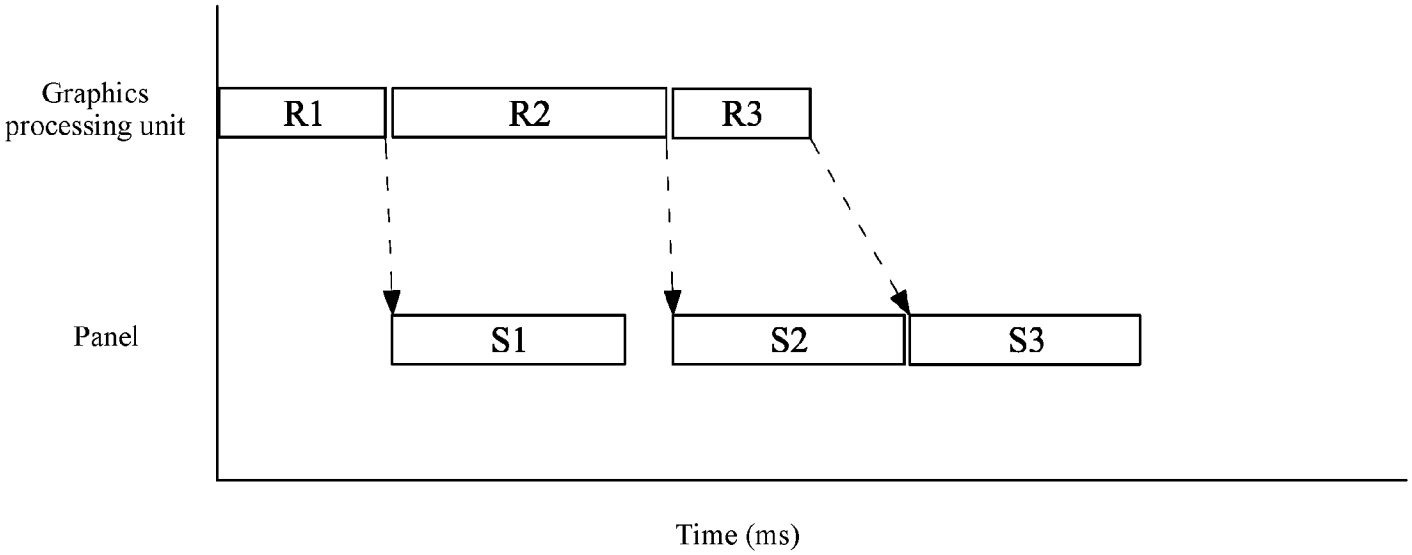
FIG. 1 is a schematic diagram that shows driving time sequences of a display adapter and a display panel.

To provide a detailed and completed description of content of the present disclosure, an illustrative description is provided for implementation aspects and specific embodiments of this application, but the implementation aspects and specific embodiments are not unique forms of implementing or applying this application. The implementation manners cover features of multiple specific embodiments, and methods, and steps and sequences thereof for constructing and operating the specific embodiments. However, another specific embodiment may be used to implement an identical and an equivalent function and step sequence. According to a common mode of operation, various features and components in the drawings are not drawn as per a scale, and a drawing manner of the various features and components is for displaying specific features and components related to this application in an optimal manner. In addition, in different drawings, a same or similar component symbol refers to a similar component/device.

Unless it is otherwise defined in this specification, meanings of scientific and technological terms used herein are the same as meanings that are understood or commonly used by a person of ordinary skill in the art to which this application belongs. Moreover, in a case not conflicting with the context, a singular noun used in this specification covers a plural form of the noun, and a plural noun used in this specification also covers a singular form of the noun.

In addition, "coupling" used in this specification may refer to direct physical or electrical mutual contacts between two or more components, or physical or electrical mutual contacts between two or more components, or may refer to mutual operations or actions between two or more components.

FIG. 1 is a schematic diagram that shows driving time sequences of a display adapter and a display panel. In recent years, with the increasingly booming development of electronic sports games, images of electronic sports games and game effects become more complicated, and a graphics processing unit (GPU) of a display adapter needs to perform a large amount of calculation. As shown in the figure, there may be problems such as damaged images and discontinuity of images caused in a case in which calculation periods R1 to R3 of the graphics processing unit do not match frame rates S1 to S3 of the display panel. To avoid the aforementioned problems, after a display period of the display panel ends, a dynamically (dynamic) adjusted blanking period (blanking) is collocated, so that the calculation periods of the graphics processing unit match the display period of the display panel. For example, after the display period (S1) of the display panel ends, a dynamically adjusted blanking period is collocated, so that finally, the calculation period R3 of the graphics processing unit matches the display period S2 of the display panel. The technology may be referred to as a dynamic matching technology, similar to the G-SYNC technology proposed by NVIDIA.

Figure 2A:
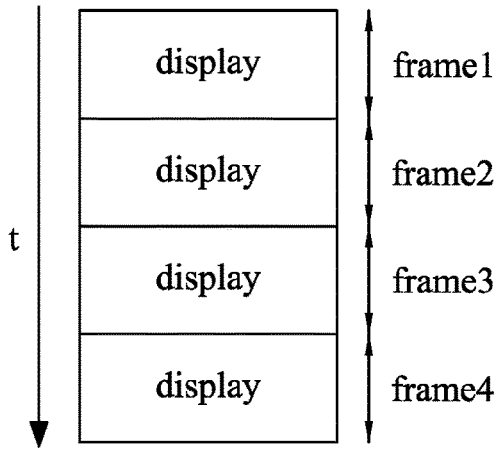
FIG. 2A and FIG. 2B are schematic diagrams that show a display time sequence of a display panel.
Figure 2B:
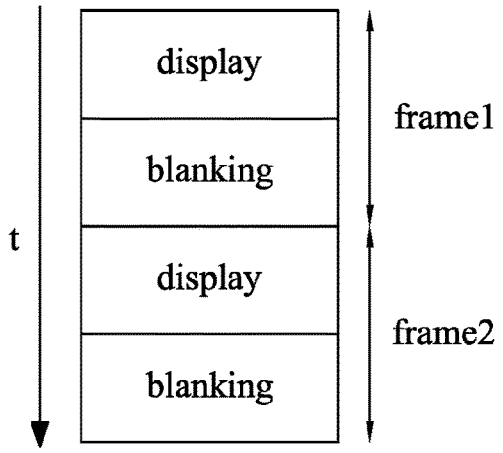

Referring to FIG. 2A and FIG. 2B, FIG. 2A and FIG. 2B are schematic diagrams that show a display time sequence of a display panel. As shown in FIG. 2A, FIG. 2A shows a display mode when the display panel operates at 60 Hz (Hz). Referring to FIG. 2B, as described above, to make a calculation period of a graphics processing unit matched with a frame rate of the display panel, a dynamic matching technology is used. After a display period (display) of the display panel ends, a dynamically adjusted blanking period (blanking) is collocated, each frame (frame) period includes a display period (display) and a blanking period (blanking), and the collocated blanking period has a time span the same as the collocated display period. In this case, a frame rate of the display pane is equal to 30 Hz. However, this application is not limited to what is shown in FIG. 2A and FIG. 2B, and what is shown in FIG. 2A and FIG. 2B are merely intended to illustratively describe one of the implementation manners of this application.

Figure 3A:
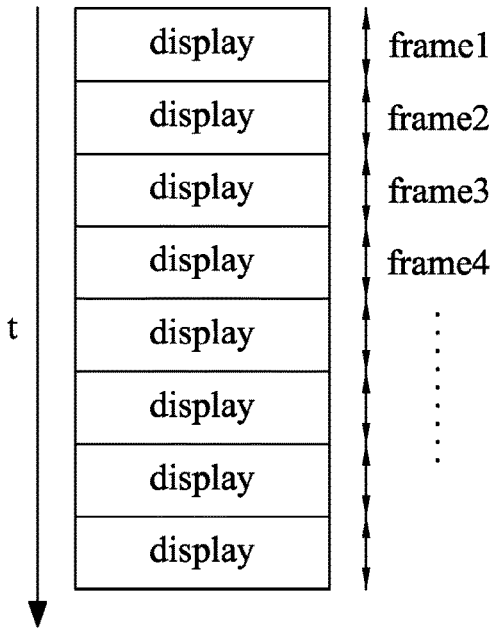
FIG. 3A and FIG. 3B are schematic diagrams that show a display time sequence of a display panel.
Figure 3B:
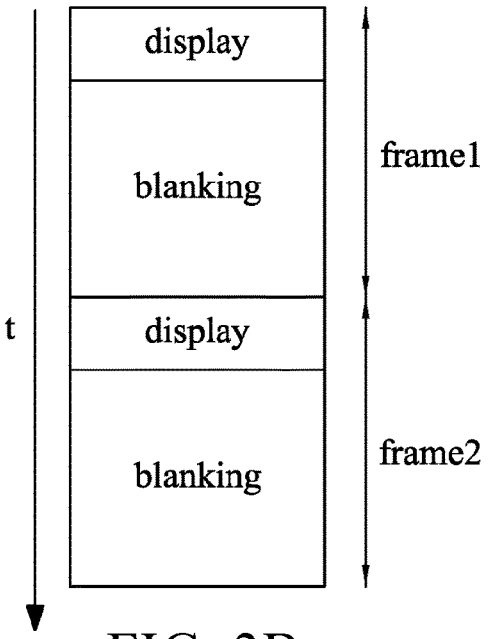

Referring to FIG. 3A and FIG. 3B, FIG. 3A and FIG. 3B are schematic diagrams that show a display time sequence of a display panel. As shown in FIG. 3A, FIG. 3A shows a display mode when the display panel operates at 120 Hz. Referring to FIG. 3B, as described above, to make a calculation period of a graphics processing unit matched with a frame rate of the display panel, a dynamic matching technology is used. After a display period (display) of the display panel ends, a dynamically adjusted blanking period (blanking) is collocated, each frame (frame) period includes a display period (display) and a blanking period (blanking), and a ratio of the collocated blanking period to the collocated display period is 1 to 3. In this case, a frame rate of the display pane is equal to 30 Hz.

To display preferable images of an electronic sports game, the display panel operates at 120 Hz during the display period (display). In this case, to avoid a problem of overheat, a column inversion technology is used. A frame rate of the display panel may probably be equal to a low frequency frame rate (for example, 30 Hz (Hz)) at which the display panel operates. In this case, a coupling phenomenon generated due to use of the column inversion technology leads to image flicker. Because human eyes are more sensitive to low frequency flicker than high frequency flicker, flicker of the display panel is therefore perceived.

Figure 4:
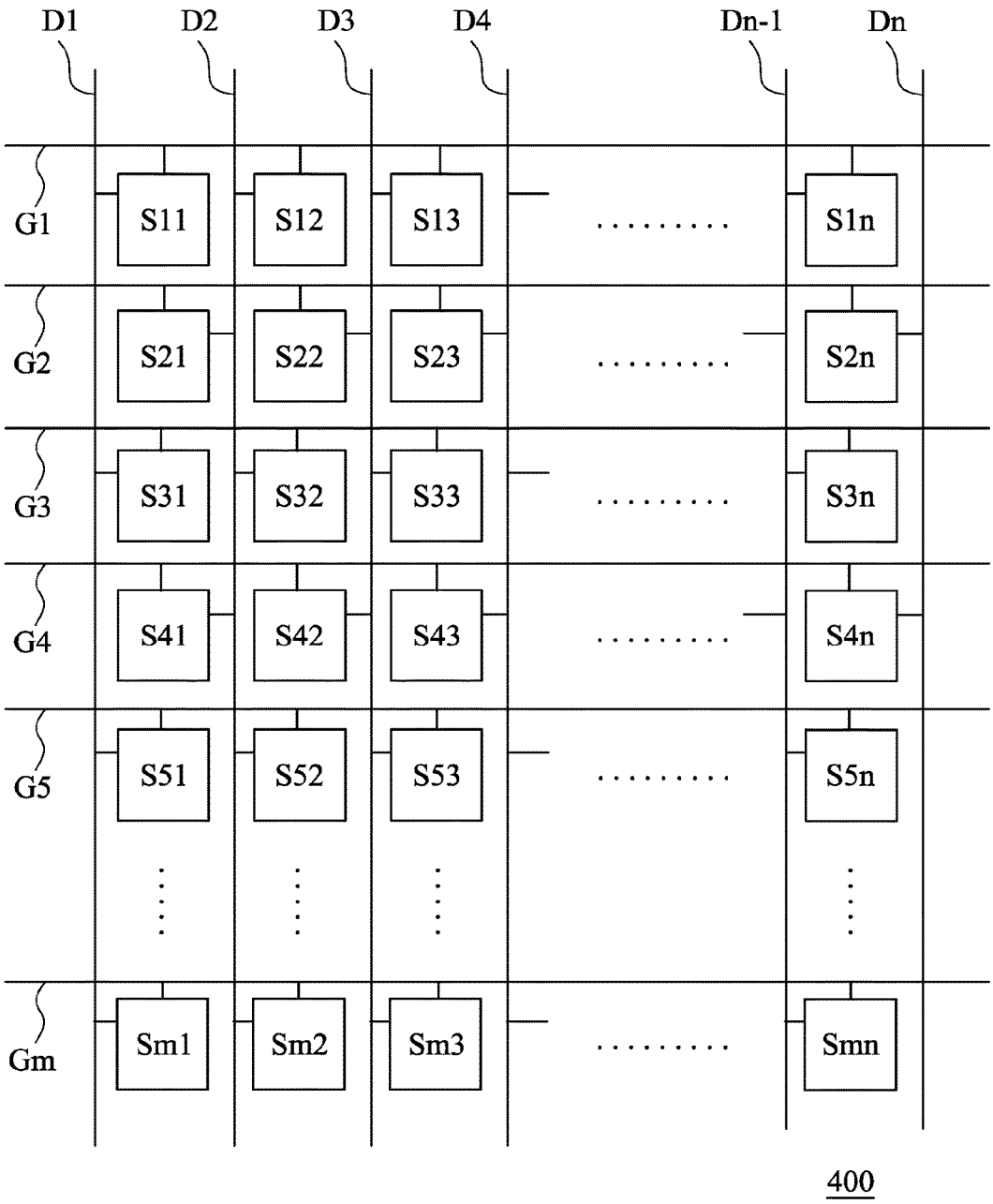
FIG. 4 is a schematic diagram of a display panel drawn according to an embodiment of this application.

Accordingly, when the display panel uses the dynamic matching technology, if the display panel uses a driving manner of column inversion, image flicker is easy to be caused due to the coupling phenomenon. To improve the aforementioned conditions, referring to FIG. 4, FIG. 4 is a schematic diagram of a display panel 400 drawn according to an embodiment of this application. As shown in the figure, the display panel 400 includes a plurality of pixels S11 to Smn and a plurality of data lines D1 to Dn. The display panel 400 uses, but is not limited to using, the dynamic matching technology (such as the G-SYNC technology proposed by NVIDIA). The pixels S11 to Smn are arranged in a plurality of columns and a plurality of rows. The embodiment shown in FIG. 4 has n columns and m rows. One (using D2 as an example) of the data lines D1 to Dn is coupled to pixels arranged in even number rows (such as pixels S12, S32, and S52 of a second column . . . ) of one of the two columns (such as a first and the second column) adjacent to the one of the data lines D2, and coupled to pixels arranged in odd number rows (such as pixels S21 and S41 . . . of the first column) of the other one of the two columns (such as the first and the second column) adjacent to data line D2. In other words, a plurality of pixels of a same column (column) is respectively coupled to two data lines which are adjacent to the plurality of pixels according to a sequence in an interlaced manner. For example, odd pixels of a same column are coupled to a data line at one side, and even pixels are coupled to a data line at the other side. In this way, images may be displayed with effect of dot inversion, but data signals of each data line still use a driving manner of column inversion.

Figure 5:
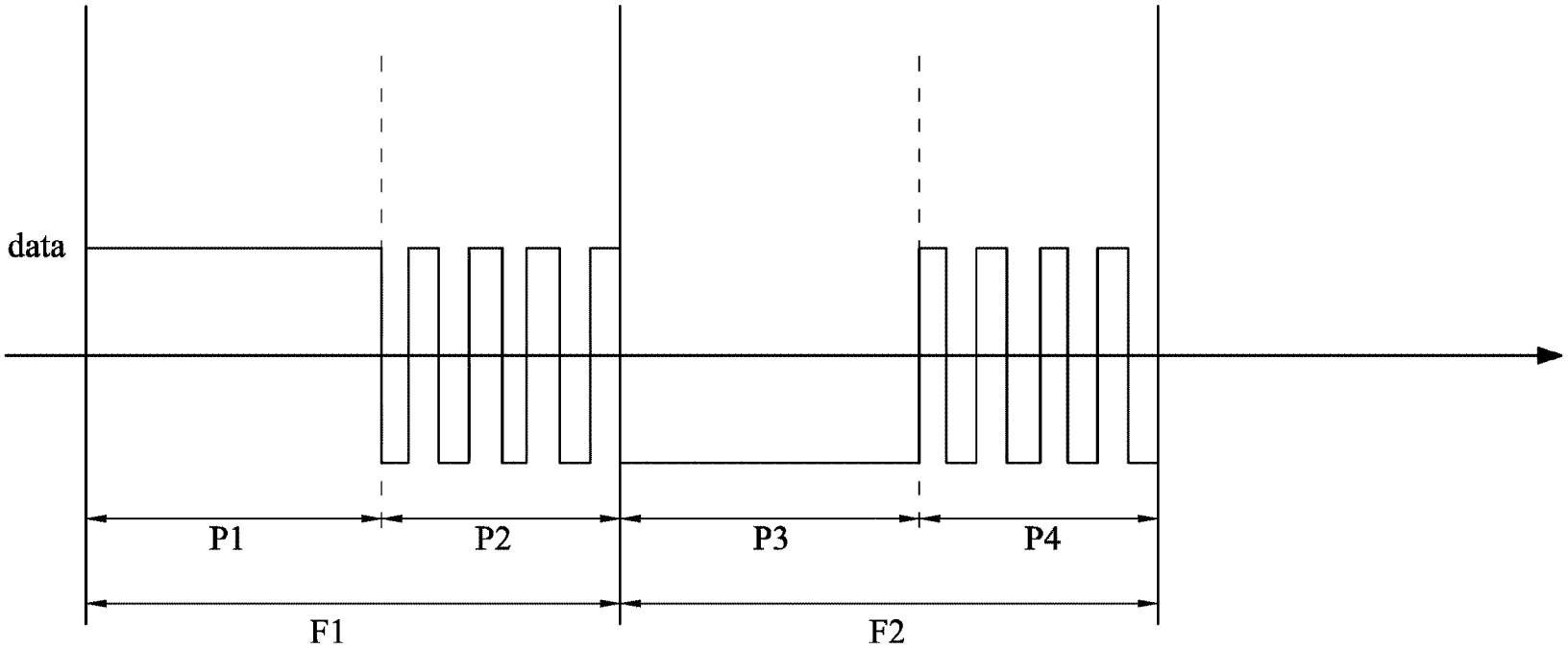
FIG. 5 is a schematic diagram of a waveform of a data signal drawn according to an embodiment of this application.

FIG. 5 is a schematic diagram of a driven waveform of a data signal drawn according to an embodiment of this application. Referring to FIG. 4 and FIG. 5 together, data lines D1 to Dn receive data signal (data) in a driving manner of column inversion during display periods P1 and P3, and receive data signal (data) in a driving manner of N-dot inversion (N-dot inversion) during display periods P2 and P4. According to an embodiment, a frame rate of a display panel 400 may be 60 Hz or 120 Hz. If the frame rate of the display panel is 60 Hz, a ratio of the display periods P1 and P3 to the blanking periods P2 and P4 is 1 to 1. If the frame rate of the display panel is 120 Hz, a ratio of the display periods P1 and P3 to the blanking periods P2 and P4 is 1 to 3. However, this application is not limited to the embodiment of FIG. 5, and the embodiment of FIG. 5 is merely intended to illustratively describe one of the implementation manners of this application.

FIG. 6A is a diagram of experimental data according to an embodiment of this application. Referring to FIG. 6A, FIG. 6A is a diagram of data of an experiment performed by using the architecture of the display panel 400 shown in FIG. 4 and the driving manner shown in FIG. 5. As shown in the figure, an indicator of a leftmost field of each row refers to a gray-scale signal provided during a blanking period of the row. For example, an indicator of a leftmost field of a first row represents that a gray-scale signal provided in the first row during the blanking period is R255. For another example, an indicator of a leftmost field of a second row represents that a gray-scale signal provided in the second row during the blanking period is G255. Indicators of remaining rows are determined by analogy. R255 refers to a red image having a gray-scale value of 255 (a brightest image), G refers to a green image, W refers to a white image, and a number that follows R, G, and W is the gray-scale value. In addition, a flicker value (dB) measured in an upper part, a middle part, or a lower part of the display panel 400 is further labeled in each row. Lower flicker value of an image represents fewer phenomena of image flicker. It may be known according to the experiment that a flicker value of the entire display panel 400 ranges from −52.1 dB to −53.7 dB, which represents that flicker phenomena of the entire display panel are of uniformity. Based on this, it may be known that although the display panel 400 uses the dynamic matching technology and uses a driving manner of column inversion during a display period, due to that data lines D1 to Dn and pixels S11 to Smn of the display panel 400 are interlacedly connected, and the display panel 400 uses a driving manner of N-dot inversion during a blanking period, coupling phenomena may be improved to reduce image flicker phenomena, and make the flicker phenomena of the entire display panel more uniform. FIG. 6A is a diagram of experimental data according to a comparative embodiment of this application. First, it should be noted that each field of a table of FIG. 6B presents a meaning similar to that of FIG. 6A, and details are not described herein again. Referring to FIG. 6B, a display panel used in FIG. 6B uses a driving manner of column inversion during a display period and a blanking period. It may be known from FIG. 6B that a flicker value of the entire display panel ranges from −37.6 to −59.5 dB, which represents that flicker phenomena of the entire display panel are not so uniform and further confirms that by means of the architecture of the display panel 400 of FIG. 4 and the driving manner of FIG. 5, flicker phenomena of the entire display panel may be ensured to be uniform (as shown in FIG. 6A).

In an embodiment, a value of N in the N-dot inversion ranges from 1 to 90. For example, the display panel 400 may use a driving manner of dot inversion (Dot inversion), 2-dot inversion (2-dot inversion) . . . or 90-dot inversion in a blanking period. This depends on actual design requirements. In another embodiment, the value of N in the N-dot inversion ranges from 20 to 90.

In another embodiment, referring to FIG. 4, a first data line (such as D1) of the data lines D1 to Dn is coupled to pixels arranged in odd number rows of a first column (such as pixels S11, S31, S51 . . . of the first column). However, this application is not limited to what is shown in FIG. 4. In the other embodiments, a first data line (such as D1) of the data lines D1 to Dn may be coupled to pixels arranged in odd number rows of a first column (such as pixels S21 and S41 . . . of the first column). This depends on actual design requirements.

In still another embodiment, a second data line (such as D2) of the data lines D1 to Dn is coupled to pixels arranged in odd number rows of a first column (such as pixels S21 and S41 . . . of the first column), and the second data line (such as D2) is coupled to pixels arranged in even number rows of a second column (such as pixels S12 and S32 . . . of the second column). In yet another embodiment, an $n^{th}$ data line (such as Dn) of the data lines D1 to Dn is coupled to pixels arranged in even number rows of an $n^{th}$ column (such as pixels S2*n*, S4*n* . . . of the $n^{th}$ column). However, this application is not limited to what is shown in FIG. 4. In the other embodiments, an $n^{th}$ data line (such as Dn) of the data lines D1 to Dn is coupled to pixels arranged in odd number rows of an $n^{th}$ column (such as pixels S1*n*, S3*n* . . . of the $n^{th}$ column). This depends on actual design requirements.

Figure 7:
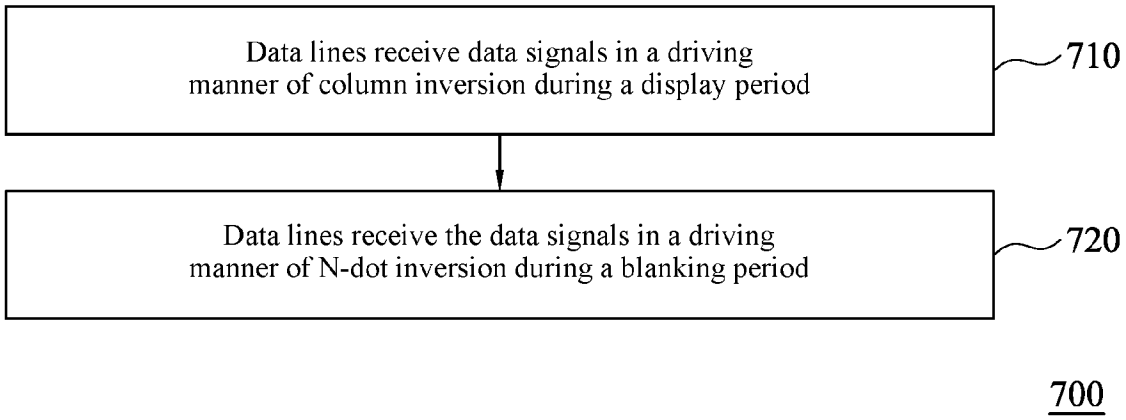
FIG. 7 is a flowchart of a method for controlling a display panel according to an embodiment of this application.

FIG. 7 is a flowchart of a method 700 for controlling a display panel according to another implementation manner of this application. As shown in the figure, the method 700 for controlling a display panel of this application includes the following steps:

Step 710: Data lines receive data signals in a driving manner of column inversion during a display period.

Step 720: Data lines receive the data signals in a driving manner of N-dot inversion during a blanking period.

To make the method 700 for controlling a display panel of this embodiment of this application comprehensible, refer to FIG. 4, FIG. 5, and FIG. 7 together. In step 710, data lines D1 to Dn receive data signal data in a manner of column inversion during display periods P1 and P3. In step 720, data lines D1 to Dn receive data signal data in a manner of N-dot inversion during blanking periods P2 and P4.

In an embodiment, a value of N in the N-dot inversion used in the method 700 for controlling a display panel ranges from 1 to 90. For example, a display panel 400 may use dot inversion (Dot inversion), 2-dot inversion (2-dot inversion) . . . or 90-dot inversion in a blanking period. This depends on actual design requirements. In another embodiment, the value of N in the N-dot inversion ranges from 20 to 90.

In another embodiment, a frame rate of the display panel 400 controlled by using the method 700 for controlling a display panel is 60 Hz (Hz) or 120 Hz (Hz). If the frame rate of the display panel 400 is 60 Hz, a ratio of the display period to the blanking period is 1 to 1. If the frame rate of the display panel 400 is 120 Hz, a ratio of the display period to the blanking period is 1 to 3. However, this application is not limited to the values shown in this embodiment, and the values are merely intended to illustratively describe one of the implementation manners of this application.

A person of ordinary skill in the art should understand that naming each step of the method 700 for controlling a display panel according to a function performed in the step is merely intended to make the techniques of this application more comprehensible, but is not intended to limit the steps. Combination of all steps into one step or division of one step into multiple steps, or replacement of any step to be performed in another step shall fall into the implementation manners of the content of the present disclosure.

Therefore, according to the technical content of this application, the embodiments of this application provide a display panel and a method for controlling the same, to improve a flicker phenomenon of the display panel and improve display quality of the display panel.

It may be known from the aforementioned implementation manners of this application that application of this application has the following advantages. The embodiments of this application provide a display panel and a method for controlling the same, to improve a flicker phenomenon of the display panel and improve display quality of the display panel.

Although specific embodiments of this application are disclosed in the above implementation manners, the specific embodiments are not intended to limit this application, and a person of ordinary skill in the art can make various replacements and modifications without departing from the principle and spirit of this application. Therefore, the protection scope of this application is subject to the scope defined by the claims accompanied with this application.

What is claimed is:

1. A method for controlling a display panel, comprising:

providing a display panel, wherein the display panel comprises a plurality of pixels arranged into a plurality of columns and rows and a plurality of data lines, one of the data lines is coupled to pixels arranged in odd number rows of one of two columns adjacent to the one of the data lines, and the one of the data lines is coupled to pixels arranged in even number rows of the other one of the two columns adjacent to the one of the data lines;

receiving data signals in a driving manner of column inversion by the data lines during a display period; and receiving the data signals in a driving manner of N-dot inversion by the data lines during a blanking period;

wherein a flicker value of the display panel ranges from −52.1 dB to −53.7 dB.

2. The method for controlling a display panel according to claim 1, wherein a value of N of the N-dot inversion ranges from 1 to 90.

3. The method for controlling a display panel according to claim 2, wherein the value of N of the N-dot inversion ranges from 20 to 90.

4. The method for controlling a display panel according to claim 1, wherein a frame rate of the display panel is 60 Hz, and a ratio of the display period to the blanking period is 1 to 1,.

5. The method for controlling a display panel according to claim 1, wherein a frame rate of the display panel is 120 Hz, and a ratio of the display period to the blanking period is 1 to 3.

6. A display panel, comprising:

a plurality of pixels arranged into a plurality of columns and rows; and a plurality of data lines, wherein one of the data lines is coupled to pixels arranged in odd number rows of one of two columns adjacent to the one of the data lines, and the one of the data lines is coupled to pixels arranged in even number rows of the other one of the two columns adjacent to the one of the data lines;

wherein the data lines receive data signals in a manner of column inversion during a display period, and receive data signals in a manner of N-dot inversion during a blanking period; and wherein a flicker value of the display panel ranges from −52.1 dB to −53.7 dB.

7. The display panel according to claim 6, wherein a value of N of the N-dot inversion ranges from 1 to 90.

8. The display panel according to claim 7, wherein the value of N of the N-dot inversion ranges from 20 to 90.

9. The display panel according to claim 6, wherein a first data line of the plurality of data lines is coupled to pixels arranged in odd number rows of a first column.

10. The display panel according to claim 9, wherein a second data line of the plurality of data lines is coupled to pixels arranged in even number rows of the first column, and the second data line is coupled to pixels arranged in odd number rows of a second column.

11. The display panel according to claim 6, wherein an $n^{th}$ data line of the data lines is coupled to pixels arranged in even number rows of an $n^{th}$ column or pixels arranged in odd number rows of an $n^{th}$ column.

12. The display panel according to claim 6, wherein a frame rate of the display panel is 60 Hz or 120 Hz.

13. The display panel according to claim 12, wherein the frame rate of the display panel is 60 Hz, and a ratio of the display period to the blanking period is 1 to 1,.

14. The display panel according to claim 12, wherein the frame rate of the display panel is 120 Hz, and a ratio of the display period to the blanking period is 1 to 3.

* * * * *